United States Patent [19]

Meyer

[11] 4,019,302

[45] Apr. 26, 1977

[54] METAL FLANGE WEB CONNECTION

[76] Inventor: Leon J. Meyer, 142 Jefferson St., Savannah, Ga. 31401

[22] Filed: Apr. 3, 1973

[21] Appl. No.: 347,362

[52] U.S. Cl. ..... 52/730; 52/729

[51] Int. Cl.[2] ..... E04C 3/32; E04C 3/07

[58] Field of Search ..... 52/282, 724–732; 29/155 R

[56] References Cited

UNITED STATES PATENTS

| | | | |
|---|---|---|---|
| 2,154,570 | 4/1939 | Holmstrom | 52/731 |
| 2,397,388 | 3/1946 | Troedsson | 52/282 |
| 2,605,867 | 8/1952 | Goodwin | 52/729 |
| 2,654,452 | 10/1953 | Priem | 52/730 |
| 3,114,244 | 12/1963 | Silver | 52/395 |
| 3,192,671 | 7/1965 | Smith | 52/282 |
| 3,310,324 | 3/1967 | Boden | 403/406 |
| 3,477,182 | 11/1969 | Fulton | 52/282 |
| 3,517,474 | 6/1970 | Lanternier | 52/729 |

FOREIGN PATENTS OR APPLICATIONS

| | | | |
|---|---|---|---|
| 473,613 | 10/1937 | United Kingdom | 52/729 |
| 1,081,423 | 8/1967 | United Kingdom | 52/282 |

*Primary Examiner*—James L. Ridgill, Jr.
*Attorney, Agent, or Firm*—Cushman, Darby & Cushman

[57] ABSTRACT

Plywood sheets are used to make structures such as beams, stress skin panels, boxes and tanks with the aid of special metal flanges which engage and form bonds with opposite faces of the plywood sheets along one or more edges of the sheets. The metal flanges define U-shaped grooves the sides of which become bonded to the faces of the plywood during assembly of the structures by serrations or other projections which press into the wood along the entire length of the grooves.

2 Claims, 11 Drawing Figures

METAL FLANGE WEB CONNECTION

This invention relates to plywood structures, their method of assembly and to special metal gripping or clamping members which are bonded along one or more edges of a plywood panel to provide strength and/or to connect the plywood edge to another plywood edge or to some other structure. In particular the invention relates to plywood beams in which the web portions of the beams are plywood panels and in which the flange portions of the beams are the special metal clamping members.

Plywood is a board, panel or sheet made up of a plurality of layers or plies of wood veneer with adjacent plies laid with their grains extending crosswise to each other. The plies are bonded together under pressure with any of several types of adhesive. Plywood is used in the construction industry for floors, walls and roofs by securing the sheets to load-bearing members such as joists, studs and rafters. However, it can also be used as the web portion of load-bearing members such as I-beams or box beams, and at the present time it is fairly common to build such members in lengths of 14 to 30 feet and greater when the more conventional non-laminated wooden members are considered to be too expensive or are difficult to obtain due to heavy market demand. Current practice is to construct the members with plywood web portions and either laminated or nonlaminated flange portions.

It is known that the design of plywood beams is similar to the design of steel plate girders in that the flange portions of the members are designed to carry the bending moment and the web portions are designed to resist shearing stresses. The joint between a flange portion and a web portion transfers shearing stresses between the flange portion and the web portion, and it is well-recognized that the strength of the joint is frequently the critical design feature of the member. That is, the joint must in effect form a continuous and permanent bond between flange and web along the entire length of the member, and failure of any portion of the bond which tends to allow relative movement between the flange and the web seriously affects the load-bearing characteristics of the member. In current practice the joint between flange and web is usually made with glue or with mechanical fasteners such as nails, or with both, and in all cases the stresses are transferred through the glue line and/or the fastener. In one conventional construction an I-beam is formed by first cutting a ⅜ inch wide groove longitudinally in one face of each two lengths of 2 × 4 lumber. The web is cut from 4-foot lengths of ⅜ inch plywood, and the cut lengths are butt-jointed together to make up the required length. The upper and lower edges of the web are inserted into the grooves in the 2 × 4's and bonded in place with adhesive. Further details of conventional plywood beam construction appear in *Modern Timber Engineering*, 4th Edition, by Scofield and O'Brien, published by Southern Pine Association, New Orleans, La., pages 176–193.

In accordance with one object of the present invention the flange portions of plywood beams or panels are lightweight metal members formed by bending or extrusion so as to have one or more channel portions each of which defines a straight slot or groove for receiving an edge of a plywood sheet, the walls of the slot or groove being designed to clamp tightly against the opposite faces of the plywood and form the necessary stress-transmitting joint without the use of glue. Preferably the surfaces of the walls of the slot or groove are formed with projections which bite into the plywood faces to form the joint therewith. The projections may take the form of a large number of serrations such as saw-tooth edges or points closely distributed over the groove walls. The projections may also be formed by punching out flaps or teeth from the metal of the flange after insertion of the plywood so that the flaps or teeth penetrate into the plywood in the manner of a gang nail such as is described in U.S. Pat. No. 3,390,902.

The invention also contemplates the use of the special metal members as connectors for joining the edge portion of a plywood sheet or panel to another sheet or panel or to some other structure.

The invention will be further understood from the following more detailed description of several embodiments taken with the drawings in which.

Figure 1:
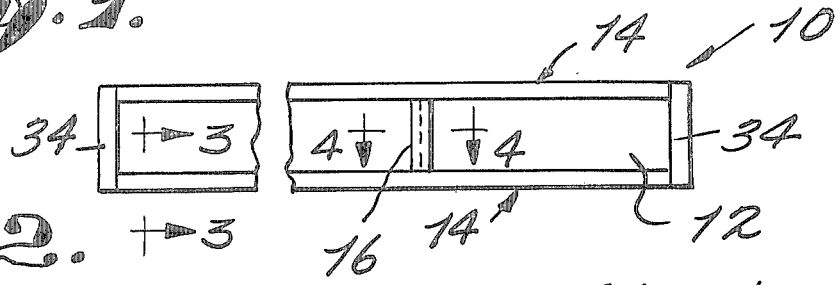
FIG. 1 is an elevational view of a plywood I-beam.
Figure 3:
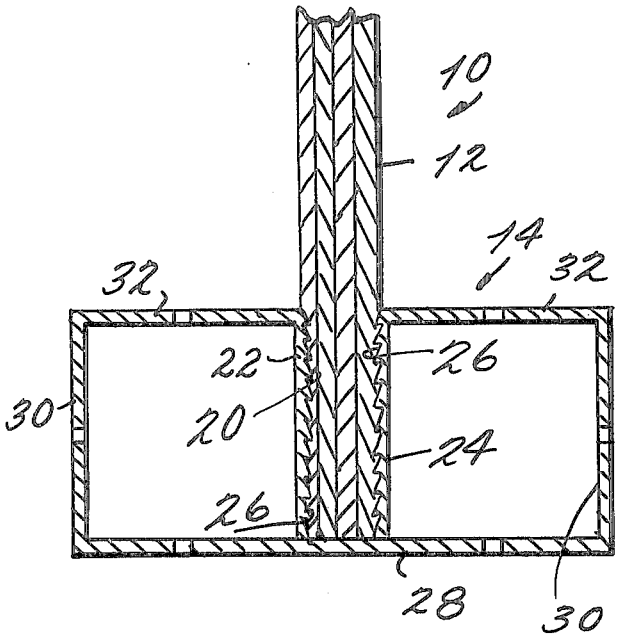
Figure 5:
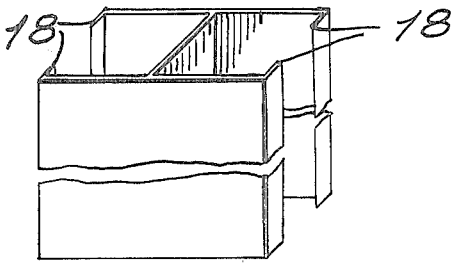
Figure 4:
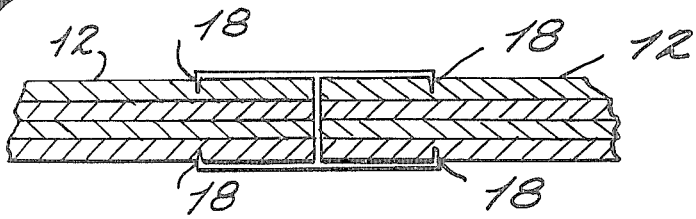
Figure 6:
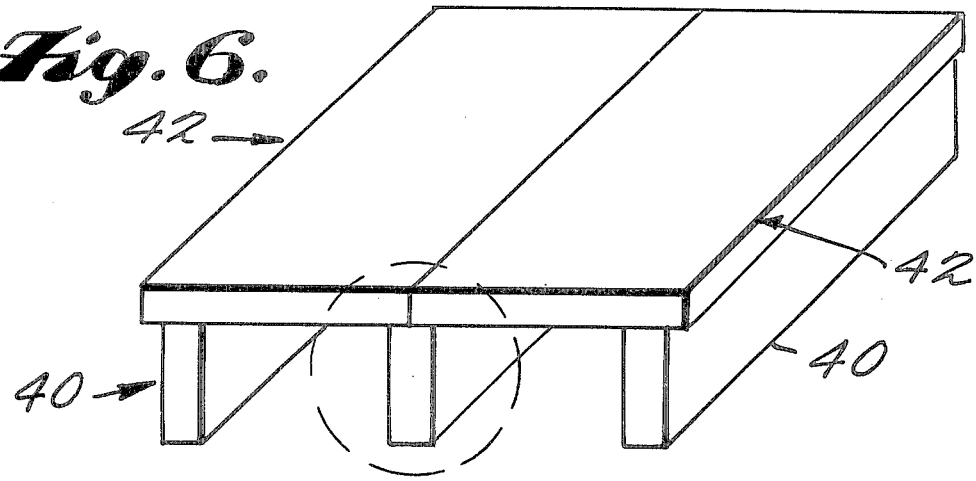
Figure 7:
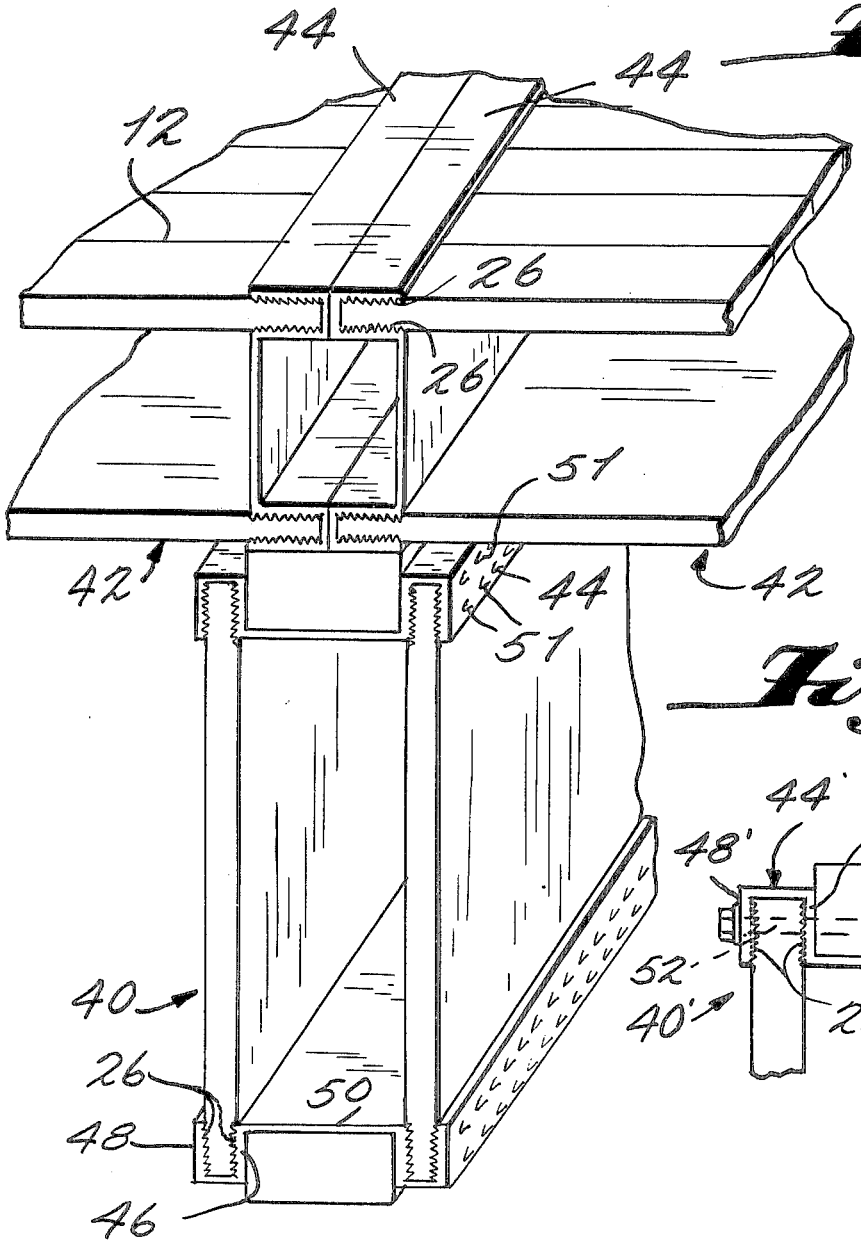
Figure 8:
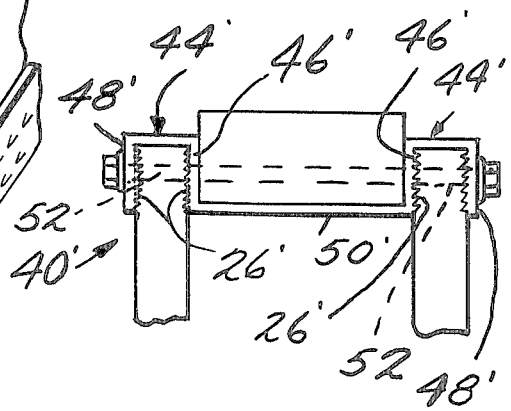
Figure 9:
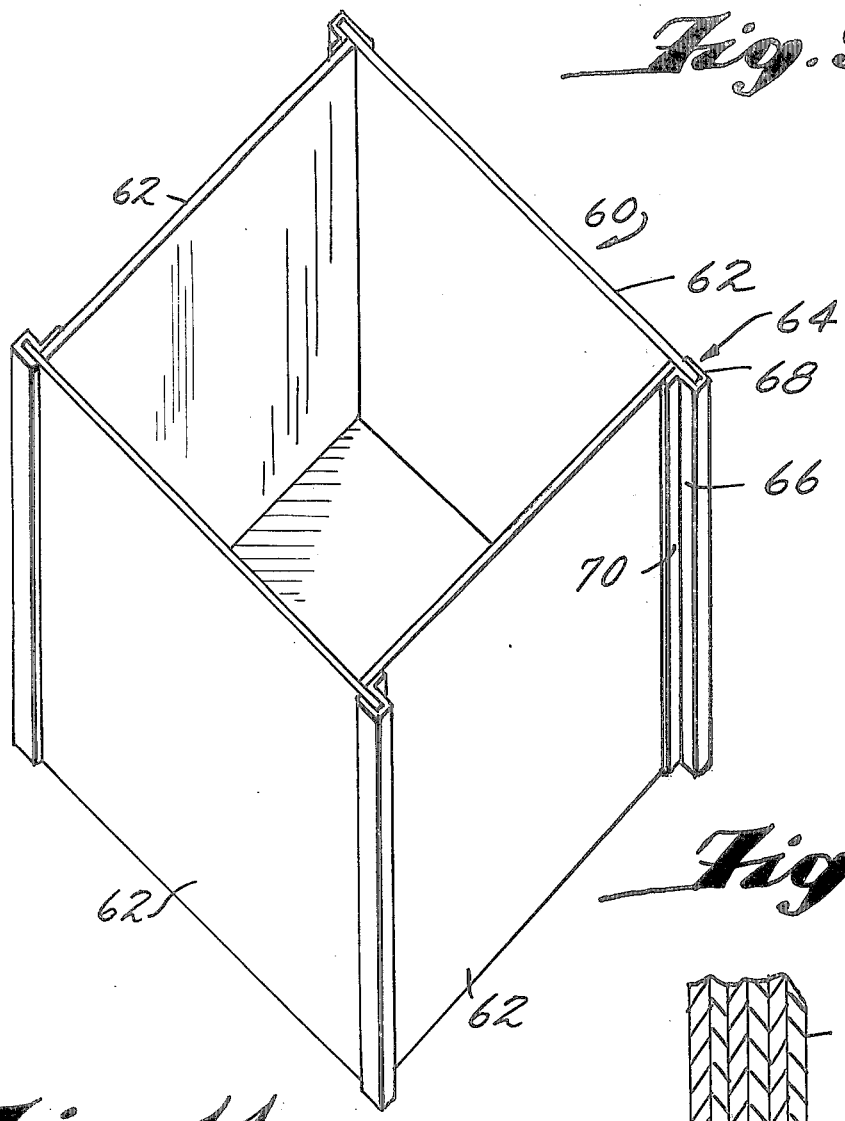

FIGS. 3 and 4 are sectional views taken on the lines 3—3 and 4—4, respectively, of FIG. 1;

FIG. 5 is a perspective view of one of the elements of FIG. 4;

FIG. 6 is a schematic perspective view of an assembly of double-wall plywood panels and plywood box beams;

FIG. 7 is a fragmentary perspective view of a portion of FIG. 6 on an enlarged scale;

FIG. 8 is a fragmentary sectional view of a box beam of modified construction;

FIG. 9 is a perspective view of a plywood box or tank; and

Figure 10:
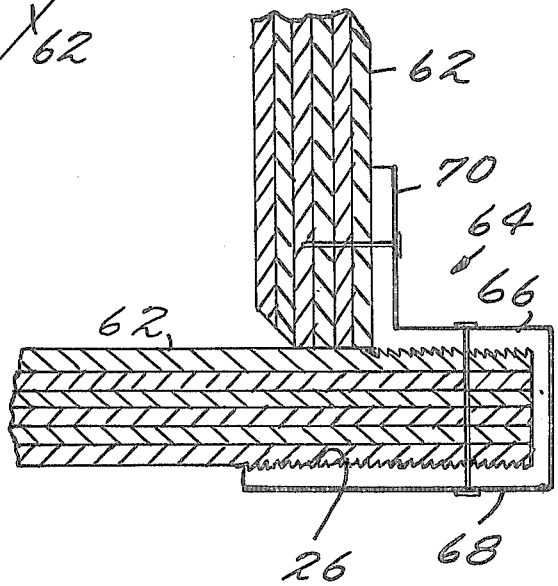
Figure 11:
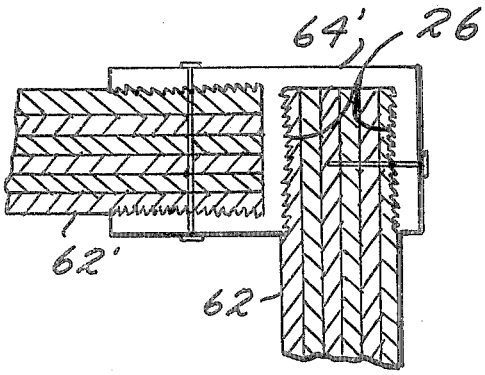

FIGS. 10 and 11 are detailed views of two forms of corner construction suitable for use with the box or tank of FIG. 9.

Figure 2:
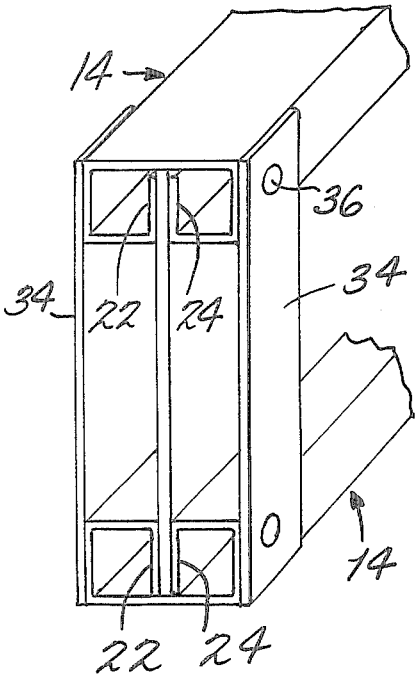
FIG. 2 is a perspective view of one end of the I-beam of FIG. 1 on an enlarged scale.

Referring to FIGS. 1, 2 and 3 there is shown an I-beam 10 having a plywood web 12 and two metal flanges 14 bonded to the upper end lower edges of the plywood web 12 in accordance with the principles of the present invention. The plywood web 12 may be a single sheet of plywood or it may be assembled from several such sheets placed face to face and bonded together. A typical sheet might be 1 × 4 ft. × ⅜ inch. Generally, two or more sheets will be butt jointed together end-to-end, as by means of a spline connector 16. As seen in FIGS. 4 and 5, the spline connector 16 may be a double-channel metal member the flange portions of which terminate in inwardly directed cleats 18 which penetrate the opposite faces of the plywood web 12 and clinch the connector 16 to the latter.

In accordance with the principles of the present invention the flanges 14 are constructed of lightweight metal connector members which are bonded to the upper and lower edges of the web 12 and which are of a size and shape to carry the bending moment applied to the beam 10 in use. In order to achieve the necessary bond between an edge portion of the web 12 and a connector member the latter is constructed in a shape which includes a channel portion defining a groove or slot 20 the walls 22 and 24 of which can be tightly engaged with the opposite faces of the web 12. In the embodiment illustrated in FIGS. 1, 2 and 3 the walls 22 and 24 are spaced apart a distance slightly less than the width of the web 12 and during assembly of the beam 10 the edge of the web 12 is forced into the slot 20 in a direction transverse to the longitudinal axis of the slot 20, as by means of a hydraulic press, to form a very tight friction fit between the walls 22, 24 and the web 12 completely along the length of the slot 20. In order to improve the bond the walls 22,24 may be provided with inwardly directed serrations 26 which penetrate into the faces of the web 12. The serrations may take the form of sharp ribs or individual saw-teeth, preferably angled to resist separation of the web 12 from the slot 20. As discussed previously, the bond between the flange of a beam and the web must transmit the stresses experienced during use, and this bond must exist uniformly along the length of the beam and prevent relative movement between flange and web.

The flanges 14 in the embodiment of FIGS. 1, 2 and 3 are shown as having a hollow box-like shape disposed symmetrically on either side of the slot 20. As shown, the box-like shapes have a horizontal common wall 28, vertical lateral walls 30 and horizontal walls 32 which connect with the walls 22 and 24. The configuration may be obtained by extruding the metal members or by bending flat plates into the desired shape. The material of construction is preferably steel or aluminum. The ends of the flanges 14 may be locked together by securing metal plates 34 to the walls 30, as by means of mechanical fasteners or welding. Mechanical fasteners, such as bolts 36 or rivets or nails may be passed transversely through the walls 22 and 24 and web 12 to aid in preventing removal of the web 12 from the slot 20, but such fasteners are not contemplated as forming part of the bond between the web 12 and the walls 22 and 24.

FIGS. 6 and 7 illustrate the principles of the invention as applied to box beams 40 and stress skin panels 42. A conventional box beam includes two or more spaced apart webs connected together at their edges by flanges. The present invention contemplates that the flanges 44 be constructed of lightweight metal members similar in function to the flanges 14 of FIGS. 1, 2 and 3. The configuration illustrated in FIGS. 6 and 7 is formed as an integral structure by extrusion or bending and includes two channel portions having inner and outer walls 46 and 48, respectively, which define between them a web-receiving slot. The ends of the inner walls are connected together by a horizontal wall 50, and a third slot facing in the opposite direction from the web-receiving slots is thereby formed between the walls 46. The third slot may loosely receive a conventional timber such as a 2 × 4 which is held in place by nails (not shown) or their fasteners which extend through appropriate holes in the walls 46.

The walls 46 and 48 are provided with serrations 26, and the beam 40 may be assembled in the manner described with respect to FIGS. 1, 2 and 3, by pressing the webs 12 into the slots. Alternatively, the serrations 26 may be formed by punching sharp-pointed flaps of metal from the walls 46 and 48 into the webs 12 after the latter have been inserted in the slots. This is illustrated in FIG. 7 where the flaps are shown at 51 on the right-hand flange 44.

The stress skin panels 42 illustrated in FIGS. 6 and 7 are identical in construction with the box beams 40 except that the dimension between the flanges 44 in the panels 42 is greater than in the box beams 40. As shown, two panels 42 are disposed with their webs 12 lying in a horizontal plane to serve as floor panels or roof panels in a building construction.

In FIG. 8 there is disclosed a box beam 40' in which the outer walls 48' of the flanges 44' are separate from the remainder of the flanges 44'. In this construction the bond between the webs 12' and the flanges 44' is formed by pressing the walls 46' and 48' toward each other, after the webs have been inserted, to thereby force the serrations 26' into the faces of the webs 12'. The walls are then locked in place to maintain the clamping action. The pressing and locking steps may be effected by inserting bolts 52 through holes formed in the walls 48' and through the webs 12' and screwing the bolts 52 into tapped holes formed in the walls 46'.

The invention, as it relates to forming a tight connection between a plywood sheet and a metal member, applies to constructions other than beams and stress skin panels. In FIGS. 9 and 10 there is shown a plywood box 60 or tank having plywood side walls 62 joined together at the corners by special metal connector members 64. Each member 64 includes a channel portion having walls 66 and 68 which define a slot for receiving the edge of a plywood wall 62. The walls 66 and 68 are provided with serrations 26 which extend into the faces of the plywood as described previously. A flange 70 extends at a right angle from the wall 66 and is joined to the other plywood wall 62 by fasteners such as nails or bolts.

FIG. 11 illustrates a connector member 64' similar to the one shown in FIG. 10 but having two channel portions each of which defines a slot for receiving an edge of a plywood wall 62'.

What is claimed is:

1. A metal connector member for use in constructing a plywood box beam or double walled plywood panel comprising an elongated metal member including two coextensive, spaced-apart parallel channel portions facing in the same direction and extending the length of said member, each of said channel portions defining a slot having parallel walls for engaging and clamping to the opposite faces of an edge portion of a plywood sheet, said walls having a large number of sharp projections extending inwardly for penetration into the plywood to thereby form a friction bond with both faces of the plywood along the length of said channel portion, the adjacent walls of the channel portions also defining a third channel portion which is parallel to and faces in a direction opposite the first two channel portions.

2. A structural assembly in the form of a plywood box beam or double-walled plywood panel comprising two metal connector members as in claim 1 and two parallel spaced-apart plywood sheets each having two opposite edge portions received within one of the slots in each connector member and engaging the walls of the slots, the projections on the wall of each slot extending into the opposite faces of the plywood sheet and forming a bond which transfers stresses between the plywood slot and the connector member and which prevents relative movement between the sheet and the member.

* * * * *